US011289023B2

(12) United States Patent
Zhang et al.

(10) Patent No.: US 11,289,023 B2
(45) Date of Patent: Mar. 29, 2022

(54) PIXEL DRIVER HAVING TWO DRIVING TIME PERIODS AND DISPLAY PANEL

(71) Applicant: Shenzhen China Star Optoelectronics Semiconductor Display Technology Co., Ltd., Shenzhen (CN)

(72) Inventors: Liuqi Zhang, Shenzhen (CN); Baixiang Han, Shenzhen (CN)

(73) Assignee: Shenzhen China Star Optoeleetronies Semiconductor Display Technology Co., Ltd., Shenzhen (CN)

( * ) Notice: Subject to any disclaimer, the term of this patent is extended or adjusted under 35 U.S.C. 154(b) by 73 days.

(21) Appl. No.: 16/627,791

(22) PCT Filed: Dec. 18, 2019

(86) PCT No.: PCT/CN2019/126325

§ 371 (c)(1),
(2) Date: Dec. 31, 2019

(87) PCT Pub. No.: WO2021/109255

PCT Pub. Date: Jun. 10, 2021

(65) Prior Publication Data

US 2021/0327356 A1 Oct. 21, 2021

(30) Foreign Application Priority Data

Dec. 2, 2019 (CN) ..... 201911215208.4

(51) Int. Cl.
*G09G 3/3258* (2016.01)
*G09G 3/3275* (2016.01)

(52) U.S. Cl.
CPC ..... *G09G 3/3258* (2013.01); *G09G 3/3275* (2013.01); *G09G 2300/0426* (2013.01); *G09G 2310/0272* (2013.01)

(58) Field of Classification Search
CPC ..... G09G 3/3258
(Continued)

(56) References Cited

U.S. PATENT DOCUMENTS

2004/0004443 A1* 1/2004 Park ..... G09G 3/3241 315/169.1
2007/0164938 A1* 7/2007 Shin ..... G09G 3/3233 345/76

(Continued)

FOREIGN PATENT DOCUMENTS

CN 1742308 3/2006
CN 1797525 7/2006

(Continued)

*Primary Examiner* — Long D Pham

(57) ABSTRACT

A pixel driver circuit and a display panel are provided. The pixel driver circuit includes a control transistor, a first transistor, a fourth transistor, a light emitting device. A gate electrode of the control transistor receives first control signals, a source electrode of the control transistor receives data signals. A drain electrode of the control transistor is connected to a gate electrode of the first transistor and a gate electrode of the fourth transistor. A source electrode of the first transistor receives first power signals. A source electrode of the fourth transistor receives second power signals. Drain electrodes of the first transistor and fourth transistor are connected to an anode of the light emitting device. The first transistor and fourth transistor correspond to a first driving time period and a second driving time period alternated. The pixel driver circuit and display panel of the present invention enhance display effect.

14 Claims, 5 Drawing Sheets

(58) Field of Classification Search
USPC ..... 345/204
See application file for complete search history.

(56) References Cited

U.S. PATENT DOCUMENTS

| | | | | |
|---|---|---|---|---|
| 2010/0141646 | A1* | 6/2010 | Tanabe | G09G 3/2022 345/214 |
| 2018/0025690 | A1 | 1/2018 | Bao et al. | |
| 2019/0325798 | A1 | 10/2019 | Chaji et al. | |

FOREIGN PATENT DOCUMENTS

| | | |
|---|---|---|
| CN | 101256738 | 9/2008 |
| CN | 101937647 | 1/2011 |
| CN | 102054436 | 5/2011 |
| CN | 102982764 | 3/2013 |
| CN | 104050927 | 9/2014 |
| CN | 105609047 | 5/2016 |
| CN | 108335668 | 7/2018 |
| CN | 109410841 | 3/2019 |
| CN | 109830212 | 5/2019 |
| CN | 110189691 | 8/2019 |
| CN | 101727826 | 6/2021 |
| KR | 2009-0043294 | 5/2009 |

* cited by examiner

PIXEL DRIVER HAVING TWO DRIVING TIME PERIODS AND DISPLAY PANEL

RELATED APPLICATIONS

This application is a National Phase of PCT Patent Application No. PCT/CN2019/126325 having International filing date of Dec. 18, 2019, which claims the benefit of priority of Chinese Patent Application No. 201911215208.4 filed on Dec. 2, 2019. The contents of the above applications are all incorporated by reference as if fully set forth herein in their entirety.

FIELD AND BACKGROUND OF THE INVENTION

The present invention relates to a field of display technologies, especially relates to a pixel driver circuit and a display panel.

An organic light emitting diode (OLED) is a display technology of self-luminescence has advantages of wide angles of view, high contrast, low power consumption, saturated colors, etc., and is therefore extensively used.

SUMMARY OF THE INVENTION

Technical Issue

However, as the use time of the display panel goes by, electrical characteristics of the transistors thereof shift, in other words, both a threshold voltage Vth and a mobility thereof shifts to cause the issue such as uneven display to lower display effect.

Therefore, it is necessary to provide a pixel driver circuit and a display panel to solve the issue of the conventional technology.

Technical Solution

An objective of the present invention is to provide a pixel driver circuit and a display panel that can enhance display effect.

To solve the above technical issue, the present invention provides a pixel driver circuit, comprising:

a control transistor, a first transistor, a fourth transistor, and a light emitting device;

a gate electrode of the control transistor inputted with a first control signal, a source electrode of the control transistor inputted with a data signal, and a drain electrode of the control transistor connected to a gate electrode of the first transistor and a gate electrode of the fourth transistor;

a source electrode of the first transistor inputted with a first power signal, a source electrode of the fourth transistor inputted with a second power signal, a drain electrode of the first transistor and a drain electrode of the fourth transistor connected to an anode of the light emitting device, a cathode of the light emitting device inputted with a third power signal;

wherein the first transistor corresponds to a first driving time period, the fourth transistor corresponds to a second driving time period, and the first driving time period and the second driving time period are alternated.

The present invention also provides a display panel comprising pixel driver circuit as described above.

Advantages

The pixel driver circuit and the display panel of the present invention, by the first transistor corresponding to first driving time period, the fourth transistor corresponding to the second driving time period, the first driving time period and the second driving time period alternated, makes the transistor in an operation status drive the light emitting device to normally emit light, the transistor in a reverse bias status recovers its device performance under the effect of an opposite voltage such that the threshold voltage of the transistor has no shift to prevent shift of electrical characteristics of the transistor and enhance display effect.

DESCRIPTION OF SPECIFIC EMBODIMENTS OF THE INVENTION

Figure 1:
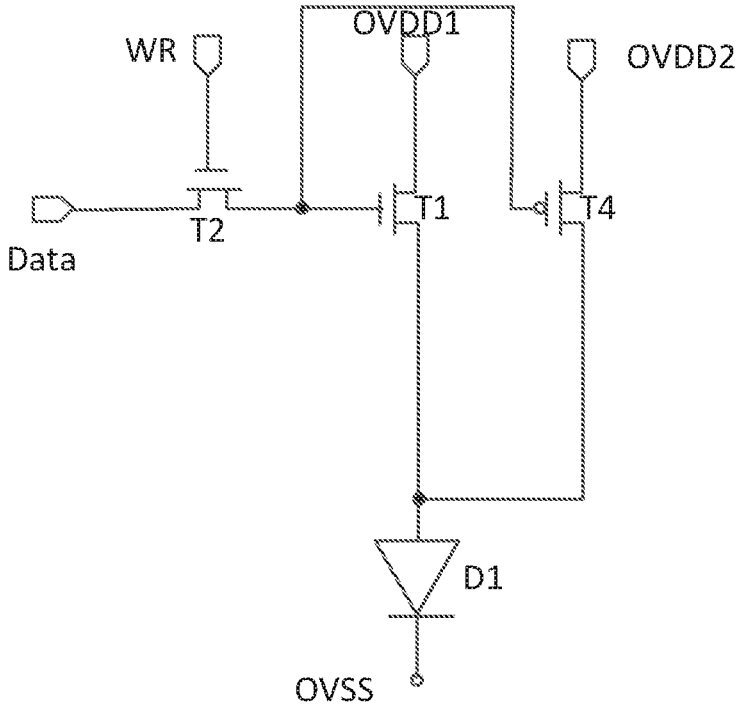
FIG. 1 is a first schematic structural view of a pixel driver circuit of a first embodiment of the present invention.

The embodiments as follows refer to the accompanying drawings for illustrating specific embodiments of the present invention that can be embodied. Directional terminologies mentioned by the present invention, for example "upper", "lower", "front", "rear", "left", "right", "top", "bottom", etc., only refer to directions of the accompanying drawings. Therefore, the employed directional terminologies are configured to indicate and make understanding for the present invention but is not for limiting the present invention. In the drawings, units with similar structures are marked with similar reference characters.

Figure 2:
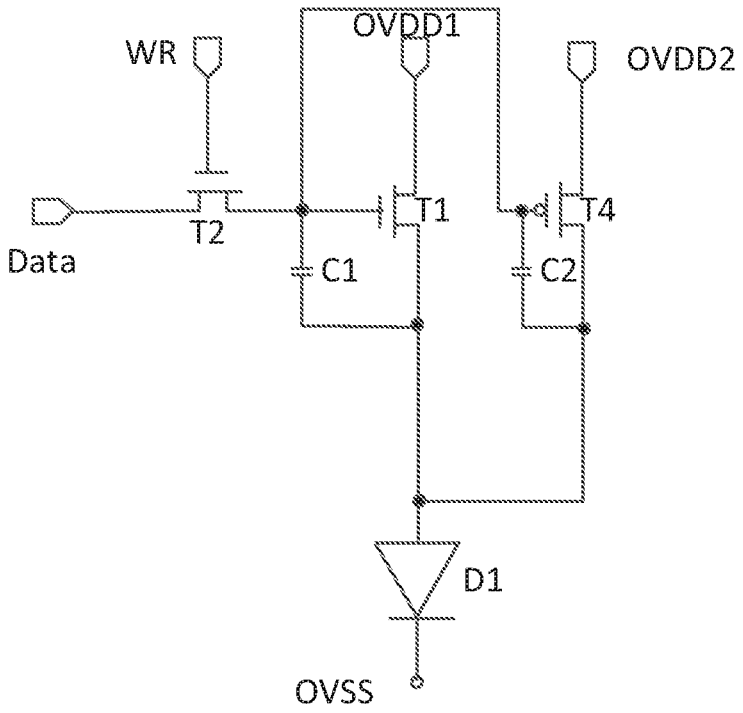
FIG. 2 is second a schematic structural view of a pixel driver circuit of the first embodiment of the present invention.

With reference to FIGS. 1 and 2, FIG. 1 is a first schematic structural view of a pixel driver circuit of a first embodiment of the present invention:

For example, as shown in FIG. 1, the pixel driver circuit of the present invention comprises: a control transistor T2, a first transistor T1, a fourth transistor T4, and a light emitting device D1.

Agate electrode of the control transistor T2 is inputted with a first control signal WR, a source electrode of the control transistor T2 is inputted with a data signal Data, A drain electrode of the control transistor T2 is connected to a gate electrode of the first transistor T1 and a gate electrode of the fourth transistor T4.

A source electrode of the first transistor T1 is inputted with a first power signal OVDD1. A source electrode of the fourth transistor T4 is inputted with a second power signal OVDD2. A drain electrode of the first transistor T1 and a drain electrode of the fourth transistor T4 are connected to an anode of the light emitting device D1, and a cathode of the light emitting device D1 is inputted with a third power signal OVSS.

A type of the first transistor T1 is NPN type, and a type of the fourth transistor T4 is PNP type.

The first transistor T1 corresponds to a first driving time period, the fourth transistor T4 corresponds to a second driving time period, and the first driving time period and the second driving time period are alternated.

The first transistor T1 corresponds to the first driving time period, the fourth transistor T4 corresponds to the second driving time period, and the first driving time period and the second driving time period are alternated.

The entire pixel driver circuit is driven according to the first driving time period and the second driving time period. Each of the first driving time period and the second driving time period comprises a first phase, a second phase, and a third phase.

In the first driving time period, the first power signal OVDD1, the data signal Data, and the third power signal OVSS are in a low electrical level (negative potential), the second power signal OVDD2 is in a high electrical level, a voltage of the first power signal OVDD1 is greater than a voltage of the data signal Data, and the voltage of the data signal Data is less than a voltage of an anode of the light emitting device. Here, Data is less than OVDD2, and OVDD2 is greater than OVSS. Because the data signal Data is in the low electrical level, the fourth transistor T4 is switched on, and the first transistor T1 is in a reverse bias status.

In the second driving time period, the first power signal OVDD1, the data signal Data, the third power signal OVSS are in a high electrical level (positive potential), the second power signal OVDD2 is in a low electrical level, and the voltage of the first power signal OVDD1 is greater than the voltage of the data signal Data, the voltage of data signal Data is less than the voltage of the anode of the light emitting device, and the voltage of the first power signal OVDD1 is greater than a voltage of the third power signal OVSS. Here, Data is greater than OVDD2, because the data signal Data is in the high electrical level, the first transistor T1 is switched on, and the fourth transistor T4 is in a reverse bias status.

With the operation according the above time sequence, the first transistor T1 and the fourth transistor T4 operate alternately, the transistor in the working status drives the light emitting device to normally emit light, and the transistor in the reverse bias status recovers its device performance under the effect of an opposite voltage such that the threshold voltage of the transistor has no shift to prepare for a next phase of normally driving the light emitting device. By such constant alternate operation, shift of electrical characteristics of the transistor is prevented to enhance display effect.

In an embodiment, with reference to FIG. 2, the pixel driver circuit further comprises a first capacitor C1 and a second capacitor C2. An end of the first capacitor C1 is connected to the drain electrode of the control transistor T2, another end of the first capacitor C1 is connected to the drain electrode of the first transistor T1. An end of the second capacitor C2 is connected to the gate electrode of the fourth transistor T4, and another end of the second capacitor C2 is connected to the drain electrode of the fourth transistor T4.

Figure 3:
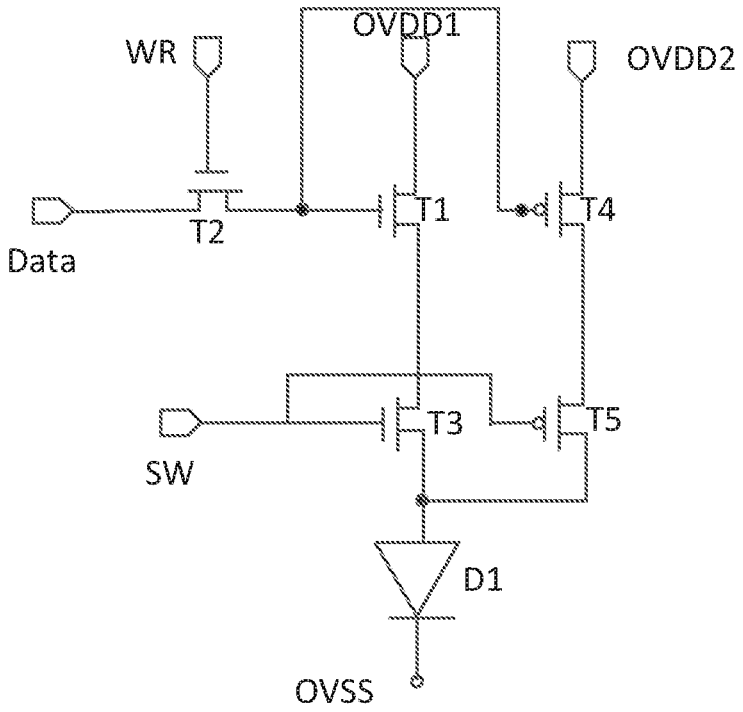
FIG. 3 is a first schematic structural view of a pixel driver circuit a second embodiment of the present invention.
Figure 4:
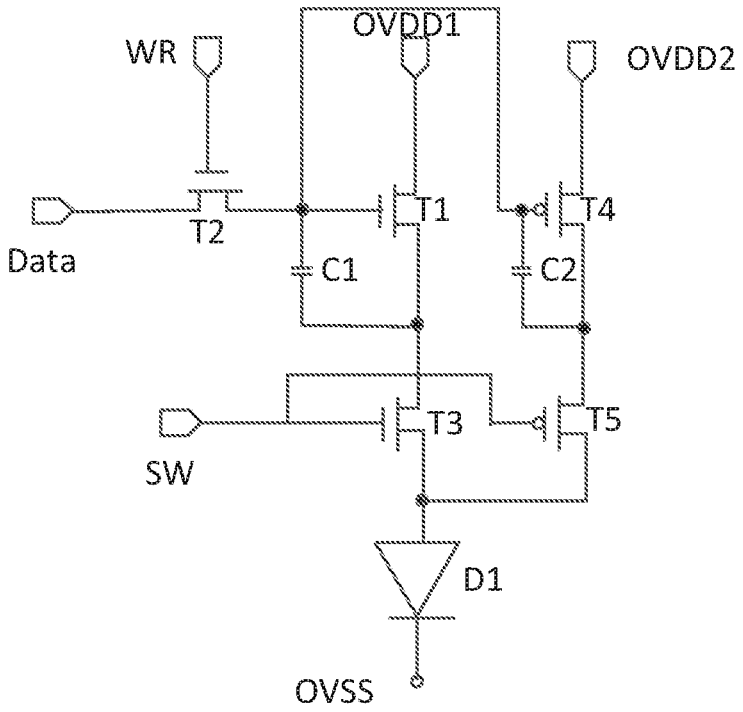
FIG. 4 is a second schematic structural view of a pixel driver circuit of the second embodiment of the present invention.
Figure 5:
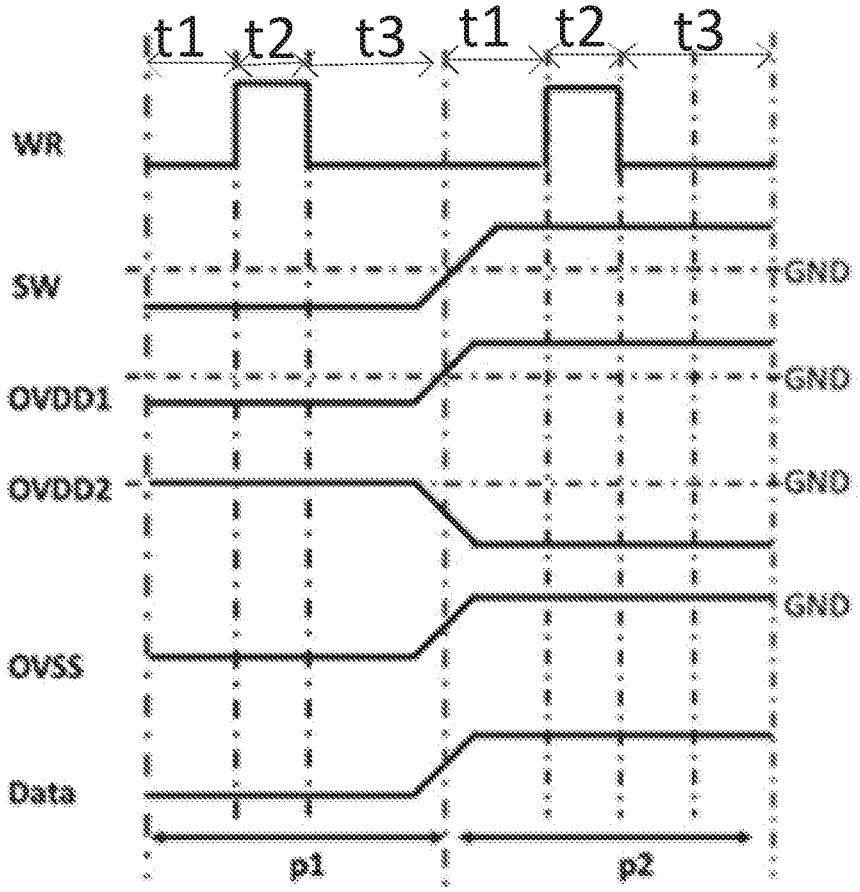
FIG. 5 is a time sequence chart of the pixel driver circuit in FIG. 4.

With reference to FIGS. 3 to 5, FIG. 3 is a first schematic structural view of a pixel driver circuit a second embodiment of the present invention:

With reference to FIG. 3, a difference of the pixel driver circuit of the present embodiment from the former embodiment is as follows.

The pixel driver circuit of the present embodiment further comprises: a third transistor T3 and a fifth transistor T5.

The drain electrode of the first transistor T1 is connected to a source electrode of the third transistor T3, the drain electrode of the fourth transistor T4 is connected to a source electrode of the fifth transistor T5. Both a gate electrode of the third transistor T3 and a gate electrode of the fifth transistor T5 are inputted with a second control signal SW;

The both a drain electrode of the third transistor T3 and a drain electrode of the fifth transistor T5 are connected to the anode of the light emitting device D1.

A combination of the first transistor T1 and the third transistor T3 corresponds to the first driving time period, and a combination of the fourth transistor T4 and the fifth transistor T5 corresponds to the second driving time period.

In an embodiment, with reference to FIG. 4, the pixel driver circuit further comprises a first capacitor C1 and a second capacitor C2. An end of the first capacitor C1 is connected to the drain electrode of the control transistor T2, and another end of the first capacitor C1 is connected to the drain electrode of the first transistor T1.

An end of the second capacitor C2 is connected to the gate electrode of the first transistor T1, and another end of the first capacitor C2 is connected to the drain electrode of the fourth transistor T4. With further reference to FIG. 5, in the first driving time period p1, the second control signal SW, the data signal Data, the first power signal OVDD1, the third power signal OVSS are in a low electrical level, and the second power signal OVDD2 is in a high electrical level. Furthermore, a voltage of the first power signal OVDD1 is less than a voltage of the data signal Data. A voltage of the second control signal SW is less than a voltage of the third power signal OVSS and is less than the voltage of the first power signal OVDD1. The data signal Data and the second control signal SW are in a low electrical level such that the first transistor T1 is in a reverse bias status, the third transistor T3 is in a switch off status, the fourth transistor T4 is connected electrically to the fifth transistor T5 such that the light emitting device emits light.

In the second driving time period, the second control signal SW, the data signal Data, the first power signal OVDD1, and the third power signal OVSS are in a high electrical level, and the second power signal OVDD2 is in a low electrical level. The voltage of the second power signal OVDD2 is less than the voltage of the data signal Data. The voltage of the second control signal SW is greater than the voltage of the third power signal OVSS and is greater than the voltage of the second power signal OVDD2. In the meantime, the data signal Data and the second control signal SW are in a high electrical level such that the fourth transistor T4 is in a reverse bias status, the fifth transistor T5 is in a switch off status, and the first transistor T1 is electrically connected to the third transistor T3 such that the light emitting device emits light. For example, in a P2 phase, OVDD2 is grounded (it can be adjusted to a positive voltage depending on actual needs), OVSS is grounded, Data, OVDD1, and SW are connected to a positive voltage. It should be understood that, the low electrical level is less than or equal to a ground voltage GND, and the high electrical level is greater than the ground voltage GND.

In an embodiment, types of the control transistor T2, the first transistor T1, and the third transistor T3 are the same, and types of the fourth transistor T4 and the fifth transistor T5 are the same.

In the present embodiment, a type of the control transistor T2, a type of the first transistor T1, and a type of the third transistor T3 are NPN type, and types of the fourth transistor T4 and the fifth transistor T5 are PNP type.

In an embodiment, wherein each of the first driving time period p1 and the second driving time period p2 comprises a first phase t1, a second phase t2, and a third phase t3. The first phase for example can be an initial phase, the second phase for example can be a data signal writing phase, and the third phase for example can be a light emitting phase.

In the second phase t2, the first control signal WR is in a high electrical level, in the first phase t1 and the second phase t3, the first control signal WR is in a low electrical level.

In the second phase t2 和 the third phase t3, the light emitting device D1 emits light.

With the operation according the above time sequence, the first transistor T1 and the third transistor T3 operate alternately with the fourth transistor T4 and the fifth transistor T5, the transistors in the working status drive the light emitting device to normally emit light, and the transistors in the reverse bias status recover their device performance under the effect of an opposite voltage such that the threshold voltage of the transistor has no shift to prepare for a next phase of normally driving the light emitting device. By such constant alternate operation, shift of electrical characteristics of the transistor is prevented to enhance display effect.

The present invention also provides a display panel, comprising any one of the above pixel driver circuits.

The pixel driver circuit and the display panel of the present invention, by the first transistor corresponding to first driving time period, the fourth transistor corresponding to the second driving time period, the first driving time period and the second driving time period alternated, makes the transistor in an operation status drive the light emitting device to normally emit light, the transistor in a reverse bias status recovers its device performance under the effect of an opposite voltage such that the threshold voltage of the transistor has no shift to prevent shift of electrical characteristics of the transistor and enhance display effect.

Although the preferred embodiments of the present invention have been disclosed as above, the aforementioned preferred embodiments are not used to limit the present invention. The person of ordinary skill in the art may make various changes and modifications without departing from the spirit and scope of the present invention. Therefore, the scope of protection of the present invention is defined by the scope of the claims.

What is claimed is:

1. A pixel driver circuit, comprising: a control transistor, a first transistor, a fourth transistor, and a light emitting device;

a gate electrode of the control transistor inputted with a first control signal, a source electrode of the control transistor inputted with a data signal, and a drain electrode of the control transistor connected to a gate electrode of the first transistor and a gate electrode of the fourth transistor;

a source electrode of the first transistor inputted with a first power signal, a source electrode of the fourth transistor inputted with a second power signal, a drain electrode of the first transistor and a drain electrode of the fourth transistor connected to an anode of the light emitting device, a cathode of the light emitting device inputted with a third power signal;

wherein the first transistor corresponds to a first driving time period, the fourth transistor corresponds to a second driving time period, and the first driving time period and the second driving time period are alternated;

wherein the pixel driver circuit further comprises a third transistor and a fifth transistor;

wherein the drain electrode of the first transistor is connected to a source electrode of the third transistor, the drain electrode of the fourth transistor is connected to a source electrode of the fifth transistor, and both a gate electrode of the third transistor and a gate electrode of the fifth transistor are inputted with a second control signal;

wherein both a drain electrode of the third transistor and a drain electrode of the fifth transistor are connected to the anode of the light emitting device;

wherein a combination of the first transistor and the third transistor corresponds to the first driving time period, and a combination of the fourth transistor and the fifth transistor corresponds to the second driving time period; and wherein in the first driving time period, the second control signal, the data signal, the first power signal, the third power signal are in a low electrical level, the second power signal is in a high electrical level; a voltage of the first power signal is less than a voltage of the data signal; a voltage of the second control signal is less than a voltage of the third power signal and is less than the voltage of the first power signal.

2. The pixel driver circuit as claimed in claim 1, wherein in the second driving time period, the second control signal, the data signal, the first power signal, and the third power signal are in a high electrical level, the second power signal in a low electrical level, a voltage of the second power signal is less than the voltage of the data signal, and the voltage of the second control signal is greater than the voltage of the third power signal and is greater than the voltage of the second power signal.

3. The pixel driver circuit as claimed in claim 1, wherein a type of the control transistor, a type of the first transistor, and a type of the third transistor are NPN type, and both a type of the fourth transistor and a type of the fifth transistor are PNP type.

4. The pixel driver circuit as claimed in claim 1, wherein the pixel driver circuit further comprises a first capacitor and a second capacitor, an end of the first capacitor is connected to the drain electrode of the control transistor, and another of the first capacitor is connected to the drain electrode of the first transistor; and an end of the second capacitor is connected to the gate electrode of the fourth transistor, and another end of the second capacitor is connected to the drain electrode of the fourth transistor.

5. The pixel driver circuit as claimed in claim 4, wherein each of the first driving time period and the second driving time period comprises a first phase, a second phase, and a third phase, in the second phase, the first control signal is in a high electrical level, and in the first phase and the second phase, the first control signal are in a low electrical level.

6. The pixel driver circuit as claimed in claim 1, wherein in the first driving time period, the data signal, the first power signal, and the third power signal are in a low electrical level, the second power signal is in a high electrical level, a voltage of the first power signal is greater than a voltage of the data signal, and the voltage of the data signal is less than a voltage of the anode of the light emitting device; and in the second driving time period, the data signal, the first power signal, and the third power signal are in a high electrical level, the second power signal is in a low electrical level, the voltage of the first power signal is greater than the voltage of the data signal, the voltage of the data signal is less than the voltage of the anode of the light emitting device, and the voltage of the first power signal is greater than a voltage of the third power signal.

7. The pixel driver circuit as claimed in claim 6, wherein in the second phase and the third phase, the light emitting device emits light.

8. A display panel, comprising a pixel driver circuit, and the pixel driver circuit comprising: a control transistor, a first transistor, a fourth transistor, and a light emitting device;

a gate electrode of the control transistor inputted with a first control signal, a source electrode of the control transistor inputted with a data signal, and a drain electrode of the control transistor connected to a gate electrode of the first transistor and a gate electrode of the fourth transistor;

a source electrode of the first transistor inputted with a first power signal, a source electrode of the fourth transistor inputted with a second power signal, a drain electrode of the first transistor and a drain electrode of the fourth transistor connected to an anode of the light emitting device, a cathode of the light emitting device inputted with a third power signal;

wherein the first transistor corresponds to a first driving time period, the fourth transistor corresponds to a second driving time period, and the first driving time period and the second driving time period are alternated;

wherein the pixel driver circuit further comprises: a third transistor and a fifth transistor;

wherein the drain electrode of the first transistor is connected to a source electrode of the third transistor, the drain electrode of the fourth transistor is connected to a source electrode of the fifth transistor, and both a gate electrode of the third transistor and a gate electrode of the fifth transistor are inputted with a second control signal;

wherein both a drain electrode of the third transistor and a drain electrode of the fifth transistor are connected to the anode of the light emitting device;

wherein a combination of the first transistor and the third transistor corresponds to the first driving time period, and a combination of the fourth transistor and the fifth transistor corresponds to the second driving time period; and wherein in the first driving time period, the second control signal, the data signal, the first power signal, the third power signal are in a low electrical level, the second power signal is in a high electrical level; a voltage of the first power signal is less than a voltage of the data signal; a voltage of the second control signal is less than a voltage of the third power signal and is less than the voltage of the first power signal.

9. The display panel as claimed in claim 8, wherein in the second driving time period, the second control signal, the data signal, the first power signal, and the third power signal are in a high electrical level, the second power signal in a low electrical level, a voltage of the second power signal is less than the voltage of the data signal, and the voltage of the second control signal is greater than the voltage of the third power signal and is greater than the voltage of the second power signal.

10. The display panel as claimed in claim 8, wherein a type of the control transistor, a type of the first transistor, and a type of the third transistor are all NPN type, and both a type of the fourth transistor and a type of the fifth transistor are PNP type.

11. The display panel as claimed in claim 8, wherein the pixel driver circuit further comprises a first capacitor and a second capacitor, an end of the first capacitor is connected to the drain electrode of the control transistor, and another of the first capacitor is connected to the drain electrode of the first transistor; and an end of the second capacitor is connected to the gate electrode of the fourth transistor, and another end of the second capacitor is connected to the drain electrode of the fourth transistor.

12. The display panel as claimed in claim 11, wherein each of the first driving time period and the second driving time period comprises a first phase, a second phase, and a third phase, in the second phase, the first control signal is in a high electrical level, and in the first phase and the second phase, the first control signal are in a low electrical level.

13. The display panel as claimed in claim 8, wherein in the first driving time period, the data signal, the first power signal, and the third power signal are in a low electrical level, the second power signal is in a high electrical level, a voltage of the first power signal is greater than a voltage of the data signal, and the voltage of the data signal is less than a voltage of the anode of the light emitting device; and in the second driving time period, the data signal, the first power signal, and the third power signal are in a high electrical level, the second power signal is in a low electrical level, the voltage of the first power signal is greater than the voltage of the data signal, the voltage of the data signal is less than the voltage of the anode of the light emitting device, and the voltage of the first power signal is greater than a voltage of the third power signal.

14. The display panel as claimed in claim 13, wherein in the second phase and the third phase, the light emitting device emits light.

* * * * *